US009080114B2

(12) United States Patent
Mendiondo et al.

(10) Patent No.: US 9,080,114 B2
(45) Date of Patent: Jul. 14, 2015

(54) METHOD FOR PRODUCING DIESEL FUEL WITH IMPROVED YIELD AND QUALITY BY INTEGRATION OF FLUIDIZED CATALYTIC CRACKING (FCC) AND HYDROCRACKING (HC)

(71) Applicant: YPF S.A., Ciudad Autonoma de Buenos Aires (AR)

(72) Inventors: Hugo Mendiondo, Buenos Aires (AR); Adrian Guzman, Ciudad Autonoma de Buenos Aires (AR); Ruben Galdeano, Ciudad Autonoma de Buenos Aires (AR)

(73) Assignee: YPF S.A., Ciudad Autonoma de Buenos Aires (AR)

( * ) Notice: Subject to any disclaimer, the term of this patent is extended or adjusted under 35 U.S.C. 154(b) by 207 days.

(21) Appl. No.: 13/766,426

(22) Filed: Feb. 13, 2013

(65) Prior Publication Data

US 2013/0206644 A1 Aug. 15, 2013

Related U.S. Application Data

(60) Provisional application No. 61/598,568, filed on Feb. 14, 2012.

(51) Int. Cl.

| | |
|---|---|
| ***C10G 69/14*** | (2006.01) |
| ***C10G 11/18*** | (2006.01) |
| ***C10G 47/16*** | (2006.01) |

(52) U.S. Cl.
CPC ..... *C10G 69/14* (2013.01); *C10G 2300/4081* (2013.01); *C10G 2400/04* (2013.01)

(58) Field of Classification Search
CPC ..... C10G 2300/4081; C10G 2400/04; C10G 69/14; C10G 11/18; C10G 47/16
USPC ..... 208/78, 80, 106, 107, 113, 118, 119
See application file for complete search history.

(56) References Cited

U.S. PATENT DOCUMENTS

| | | | |
|---|---|---|---|
| 4,192,734 | A | 3/1980 | Pavlica et al. |
| 7,074,321 | B1 | 7/2006 | Kalnes |

FOREIGN PATENT DOCUMENTS

| | | | |
|---|---|---|---|
| EP | 0436253 | A1 | 7/1991 |

*Primary Examiner* — Walter D Griffin
*Assistant Examiner* — Derek Mueller
(74) *Attorney, Agent, or Firm* — Muncy, Geissler, Olds & Lowe, P.C.

(57) ABSTRACT

A method for producing diesel fuel with improved yield and quality by integration of fluidized catalytic cracking (FCC) and hydrocracking (HC), comprising the following stages:

arrangement of FCC and HC processes in parallel;

feedstock segregation to each of such processes depending on the content of aromatic hydrocarbons; and a fractioning common stage for both output streams from HC and FCC processes, also comprising recycling the unconverted fraction towards the FCC unit.

13 Claims, 1 Drawing Sheet

METHOD FOR PRODUCING DIESEL FUEL WITH IMPROVED YIELD AND QUALITY BY INTEGRATION OF FLUIDIZED CATALYTIC CRACKING (FCC) AND HYDROCRACKING (HC)

FIELD OF THE INVENTION

This invention refers to a method for improving the production and quality of diesel fuel by integration of fluidized catalytic cracking (FCC) and hydrocracking (HC).

BACKGROUND OF THE INVENTION

Diesel fuel, also referred to as gas-oil, hereinafter, without distinction, simply, "diesel", is a liquid fuel, substantially composed of saturated hydrocarbons (primarily paraffins including n- or iso-paraffins, and cycloparaffins) and aromatic hydrocarbons, which are used in Diesel engines or heating equipment. Diesel obtained by petroleum refining is called petrodiesel. In this context, diesel fuel is the fraction or cut of crude oil distilling between 200° C. and 370° C. at atmospheric pressure. There are other definitions for diesel fuel derived from other carbon sources, such as biodiesel, obtained from vegetable oils.

Diesel is mainly used in compression ignition engines, which operate according to the Diesel Cycle. One of the main quality standards of the diesel fuel is the "cetane number", which measures the desirable autoignition tendency in such engines. Unlike the octane number for gasoline, the cetane number is not closely related to engine efficiency, but it will measure the emission generation tendency, particularly of hydrocarbons, carbon monoxide and particles, during engine operation. According to the cetane number scale, the autoignition response of methyl-naphtalene (aromatic hydrocarbon) is assigned a score of 0, and that of hexadecane (paraffinic hydrocarbon) is assigned a score of 100. A high content of aromatics in a diesel fuel will have an adverse impact on its cetane number.

In a traditional industrial petroleum refining process, most of the diesel produced is derived from the atmospheric distillation of crude oil. However, some part, currently near 30% of the diesel produced by refineries, is obtained by fluidized catalytic cracking (FCC). This process is mainly fed by a mixture of cuts referred to as atmospheric heavy gas oil (HGO), heavy coker gas oil (HCGO) and heavy vacuum gas oil (VGO), derived from previous processes. The main objective of FCC is obtaining high quality gasolines/naphthas, due to the high content of aromatic hydrocarbons, which have a positive impact on the octane number. Nevertheless, this characteristic also leads to a low cetane number and lower quality of the diesel obtained in this process. This is due to the fact that aromatic polycyclic compounds generate small fractions of coke and gas or remain without reaction in the presence of the acid catalytic in the FCC process and leave the unit as Light Cycle Oil (LCO) and Heavy Cycle Oil (HCO). This also limits the overall conversion of the process.

Another source of diesel in a traditional refinery is hydrocracking (HC), wherein catalytic cracking is associated to hydrogenation reactions. By means of this process, aromatic polycyclic compounds can lead to low-molecular-weight cyclic compounds within the gasoline and diesel boiling range.

As a result of this, both FCC and HC are processes that take place jointly in many refineries, in different combinations and receiving different feedstocks, depending on the specific objectives of the refinery. Several patent documents are known to mention processes for obtaining light hydrocarbons, such as naphtha and diesel, simultaneously applying HC and FCC processes, such as patent applications EP 436253 A1, JP 08-218082, EP 2154225 A1, WO 2009/085696 and US 2010/065475 A1, and patents U.S. Pat. No. 4,192,734, GB 1001449 A, GB 141306 A and U.S. Pat. No. 7,074,321 B1.

Such documents consider the simultaneous use of HC and FCC for treating feedstocks from several sources, in which each process has its own fractionation unit.

Patent application EP 436253 A1 refers to arrangement of HC and FCC processes in parallel, including feedstocks from different sources, in which each process has its own fractioning stage.

Patent application JP 08-218082 refers to obtaining a high quality diesel by mixing streams derived from HC and FCC processes.

Patent application EP 2154225 A1 refers to an integrated process for the conversion of heavy hydrocarbons to a light distillate and/or mid-distillate, combining a HC, a FCC and a hydroconversion process.

Patent application WO 2009/085696 refers to a process wherein HC and FCC processes are serially combined.

Patent application US 2010/065475 A1 refers to a FCC process, with pre-treatment by hydrocracking, for feedstocks derived from petroleum and biological sources. U.S. Pat. No. 4,192,734 refers to the production of high quality diesel from a stream resulting from the vacuum distillation of the atmospheric distillation residue, including the possibility to use HC and FCC in parallel.

Patent GB 1001449 A refers to a hydrocarbon conversion process combining HC and FCC with different feedstocks, but comprising individual fractioning in each process.

Patent GB 141306 A refers to obtaining high-octane gasoline by converting paraffinic naphtha by HC and FCC processes.

U.S. Pat. No. 7,074,321 B1 refers to the use of FCC for converting the unconverted fraction of the HC process.

Most of such patents are mainly intended to improve gasoline yield and quality, being the products derived from petroleum refining with highest commercial value. Based on current international market trends and ultra low sulfur requirements, there is an increasing need for the development of processes aimed at improving the yield and quality of the diesel obtained from refining, in particular, the diesel produced by FCC processes.

BRIEF DESCRIPTION OF THE INVENTION

It is an object of the present invention a method for producing diesel fuel with improved yield and quality by integration of fluidized catalytic cracking (FCC) and hydrocracking (HC), comprising the following stages:

- arrangement of FCC and HC processes in parallel;
- feedstock segregation to each of such processes depending on the content of aromatic hydrocarbons; and
- a common fractioning stage for both output streams from HC and FCC processes, also comprising recycling the unconverted fraction towards the FCC unit.

The method of the present application allows obtaining diesel with improved yield and quality produced by a FCC process by incorporation of a HC unit fed with highly aromatic feedstock, segregated by source according to the criteria explained in detail below in the present invention. Such feedstock is an excellent source for the HC process since it will be then converted to mid-distillate and gasoline. Reducing the aromatic contents results in improved cetane number of the diesel produced. Additionally, the unconverted fraction is recycled into the FCC process, because it is a feedstock rich in hydrogen and thus it can improve the conversion of the overall process. Since the HC process selectively drives the transformation of the aromatic rings into high quality diesel, the yield thereof will be significantly increased as compared to the traditional FCC process.

In one preferred embodiment of the method of the present invention, at least a portion of the hydrocracking reactor effluent is used to preheat the feed to the same reactor, thus reducing its temperature before mixing with the FCC unit effluent and entering the common fractioning stage.

In another preferred embodiment of the method of the present invention, said common fractioning stage for both output streams from HC and FCC processes, comprises recycling the unconverted heavy gasoil to the riser of the FCC unit and recycling the decanted gasoil to the HC unit.

In another preferred embodiment of the method of the present invention, said common fractioning stage for both output streams from HC and FCC processes, comprises optionally recycling a portion of the decanted gasoil stream to the HC unit, comprises mixing the remaining portion or the whole of said stream with the unconverted heavy gasoil, and comprises recycling the resulting mixed stream to extinction towards the riser of the FCC unit, thus allowing control of the carbon balance in the FCC unit.

In another preferred embodiment of the method of the present invention, the temperature of the effluent from the hydrocracking reactor can be adjusted in the range between 300° C. and 390° C.

In a preferred embodiment of the method of the present invention, the operation pressure of the FCC reactor is between 2-5 bar and the temperature of its effluent is between 500° C. and 580° C.

In another preferred embodiment of the method of the present invention, the hydrocracking reactor is being operated with conversion rates between 20% and 60%.

In yet another preferred embodiment of the method of the present invention, the temperature of the hydrocracking reactor effluent, after heat exchange to preheat the feed to the same reactor, is from about 100° C. to 250° C. and the temperature of the FCC reactor effluent is about 530° C.

In yet another preferred embodiment of the method of the present invention, the hydrocracking reactor operates with conversion between 20% and 60% and pressures between 70 Bar and 150 Bar, and temperatures between 340° C. and 400° C.

In another preferred embodiment of the method of the present invention, the hydrocracking unit operates ancillary to FCC, thereby improving a portion of the feedstock thereof, which has low performance as compared to the catalytic cracking process, and adding value thereto, by selective incorporation of hydrogen while simultaneously producing high-quality diesel.

In another preferred embodiment of the method of the present invention, the hydrocracking effluent exchanges heat by direct countercurrent contact with the hot vapors coming from the FCC Reactor in the contactor of the flash section zone of the main fractionator. Minimal pump-around circulation is adjusted for stable balanced operation and for shutdown events.

In another preferred embodiment of the method of the present invention, the contaminants which are present in hydrocracking products ($H_2S$, $NH_3$, $H_2O$ and others) are stripped in the contactor of the flash section zone of the main fractionator by hot gases of FCC. Light and medium hydrocarbons are distilled together with FCC products.

DETAILED DESCRIPTION OF THE INVENTION

In a traditional refinery there are several processes for producing and/or separating the different crude oil cuts or fractions and obtaining products with high commercial value therefrom. The products produced can be "light" or "heavy" depending on their distillation temperature range at a given pressure. Among the most usual processes that take place in a refinery are the following (non-restrictive list):

- atmospheric distillation or topping: several product streams, referred to as topping streams, are derived therefrom;
- vacuum distillation (or conversion): several product streams, referred to as conversion streams, are derived therefrom;
- hydrotreatment: this process is mainly aimed at removing sulfur from the products obtained in the atmospheric distillation process;
- catalytic reforming: this process is mainly aimed at increasing the octane number of a naphtha stream, yielding hydrogen;
- solvent raffination: group of processes wherein a solvent is used for extracting compounds in some the refinery process streams. In particular, extraction with furfural is aimed at removing aromatic hydrocarbons;
- fluidized catalytic cracking (FCC): as mentioned above, this process is aimed at producing light products from heavier product streams;
- hydrocracking (HC): as mentioned above, this process is aimed at producing light products by hydrogenation reactions;
- gas treatment and compression;
- coking.

The invention will be further described in detail referring to the attached figures, which depict preferred embodiments of the invention.

Figure 1:
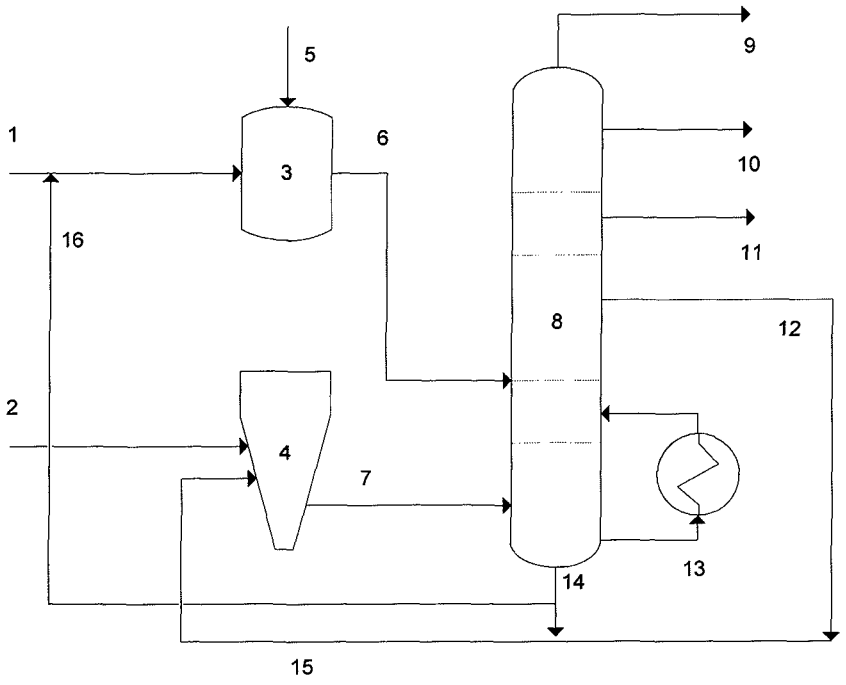
FIG. 1 depicts a flow diagram of the process of this invention, recycling a portion of the decanted gasoil stream to the HC unit, mixing the remaining portion of said stream with the unconverted heavy gasoil, and recycling the resulting mixed stream towards the FCC unit.

FIG. 1 shows a flow diagram of the method of the present invention, wherein a hydrocracking unit (3) is integrated with a fluidized catalytic cracking unit (4). The hydrocracking unit (3) is fed by a hydrocarbon stream (1), composed of a mixture of heavy gas-oil produced by the conversion units (Delayed Coker and FCC) and aromatic extract streams from lubricant units, plus a recycle stream (16) from the bottom of the fractioning column (8). In the unit (3) a hydrogen stream (5) is added. The FCC unit (4) is fed by a mixture of topping heavy gas-oil (2) and a recycle stream (15) that enters the riser from the fractioning column (8). The column (8) is fed by the output stream (6) of the reactor of the hydrocracking unit (3) and the output stream (7) of the reactor of FCC (4).

The following are produced in the fractioning stage (8):

a) a light product stream (9) to be fed into the refinery plant compression plant, b) a light product stream (10) in the gasoline/naphtha boiling range, and c) a product stream (11) in the diesel boiling range.

A stream (12) and a stream (14) composed of a mixture of unconverted fractions from HC and FCC are also obtained, being recycled as stream (15) into the riser of the FCC unit. A portion of stream (14) is optionally recycled to the HC unit.

In a preferred operation of fractioning unit (8), a stream is recycled for quenching the unit (8) by generation of steam by means of a boiler (13) operating with a minimum duty regarding its nominal capacity in order to ensure an adequate operation of the quenching section of the main fractioning tower of the FCC.

In another preferred operation of the fractioning unit, in the event that the HC unit (3) is out of service, live steam is produced at the boiler's highest nominal capacity for quenching the bottom of column (8).

Figure 2:
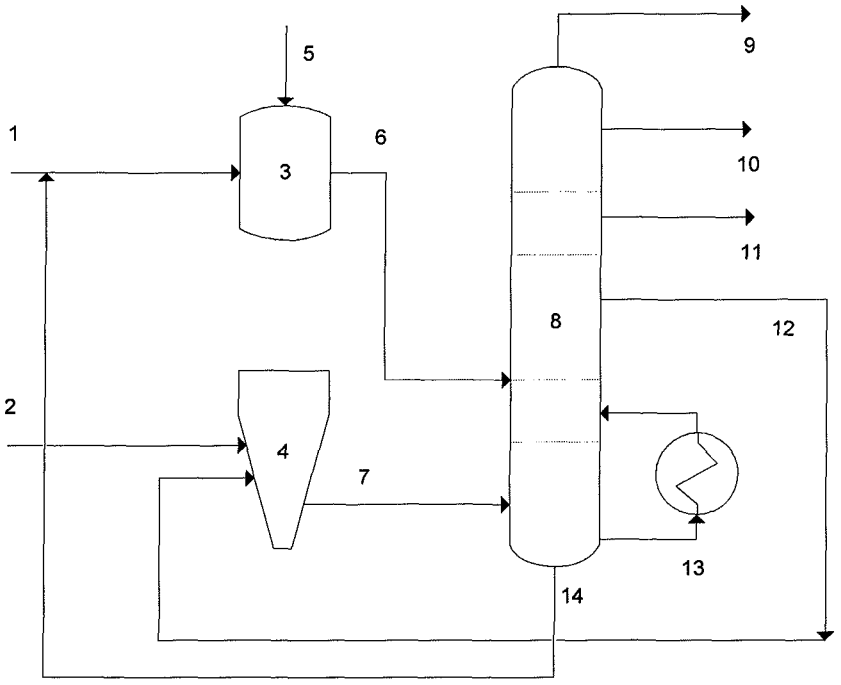
FIG. 2 depicts a flow diagram of the process of this invention, recycling the unconverted heavy gasoil to the FCC unit and recycling the decanted gasoil to the HC unit.

FIG. 2 shows a flow diagram of a preferred embodiment of the method of the present invention, recycling stream (12) to the riser of the FCC unit, and recycling stream (14) to the HC unit, without mixing both streams.

The method of the invention is a combination of the HC and FCC separate processes which represents a substantial improvement since it leads to high commercial value products with higher yield and improved quality, such as middistillate, naphtha and especially diesel and lighter products.

EXAMPLE 1

The feedstock fed into HC and FCC units is selected in accordance with aromatic hydrocarbon content criteria. The aromatic content of feedstock in a traditional FCC process is shown in Table 1.

Such feedstock can be segregated upon production, that is, in the process units upstream from the FCC process which produce the streams that are normally fed into the FCC unit, namely, topping, vacuum distillation, delayed coking unit and furfural extraction of the lubricant section. Additionally, the decanted oil or clarified oil streams from any other existing FCC units in the refinery are sent to the HC process so as to feed the FCC unit only with heavy gas-oil stream from topping. This way, the streams that are more aromatic are fed into a HC unit, whereas the ones that are more paraffinic are fed into the FCC unit, taking advantage of each process features regarding these types of feedstock. Thus, the aromatic content of the feedstock fed into the FCC unit is reduced as compared with the traditional process. Consequently, less dry gases and coke are produced, allowing an increase in the feedstock stream fed to FCC process or the addition of heavier feedstock, such as reduced crude oil. More importantly, the preheat, reaction and regeneration sections operate in less constrained conditions, because converted products from the HC process are withdrawn by fractionation, thus releasing their volumetric flow to additional fresh feedstock if desired.

The typical aromatic content of the different streams feeding cracking processes are shown in Table 1.

TABLE 1

| | Furfural extract | LGO | Decanted Oil | HGO | Topping HGO | Combined feedstock |
|---|---|---|---|---|---|---|
| Aromatics % w/w | 50/70 | 20 | 70/80 | 30/40 | 10/20 | 40/50 |

Wherein LGO stands for light gas-oil and HGO stands for heavy gas-oil.

As it is known in the art, for a correct operation of FCC unit, it is necessary that the heat, carbon and pressure balances be verified. During the continuous operation of the FCC process, the activity of the catalyst is decreased by the deposition of carbon on its surface. The catalyst is regenerated by carbon combustion, releasing the energy needed in order to maintain the reactor's temperature, since cracking reactions are strongly endothermic.

This aspect shows the coupling existing between the heat balance and carbon balance of the unit by means of the catalyst circulation. Since the feed to the FCC of the present invention is significantly more paraffinic than the feed to the traditional process, because of the use of topping streams on the one hand, and the hydrocracking that hydrogenates the aromatic rings on the other, carbon precursor species are needed in the feed in order to quickly add the necessary heat in the FCC regenerator. This way, the unconverted fraction in the FCC can be recycled to extinction, since as a result of being composed of polyaromatic rings, coke and light gases are created. Carbon balance governs the circulation of the catalyst and allows the autothermal continuous operation of the FCC unit.

From the fractioning stage, not only diesel fuel is obtained but also other hydrocarbon fractions in the naphtha or gasoline boiling range.

Thus, operating with the hydrocracking catalyst selectivity results in producing non-hydrogenated aromatic rings which increase the octane number of the gasoline produced.

In one preferred embodiment of the invention, shown in FIG. 1, a portion of decanted heavy gas-oil can be recycled towards the hydrocracking unit by stream (16), in order to hydrogenate the heavy aromatic rings, obtaining gas-oil with improved quality. Such recycle will in turn have an influence on the carbon balance of the FCC unit, and can be designed as the minimum needed in order to maintain the catalyst regenerator temperature in the FCC unit. If necessary, this heavier product stream could also be recovered.

The hydrocracking unit is composed of one or two fixed-bed reactors, that is, one-stage or two-stage hydrocracking, with or without total recycling of the bottom residue up to total extinction. Two-stage hydrocracking provides better performance. In the first stage, sulfur-nitrogen compounds are removed and aromatics that aid in the performance of the second stage are partially saturated. In the second stage, cracking is performed up to high rates without the presence of sulfur and nitrogen compounds. The latter pollutant inhibits the acidity of the catalyst, thus decreasing the cracking activity thereof. Cutting-edge catalysts are based on acid catalysts composed of zeolites, which operate under high partial hydrogen pressure and temperature conditions.

Zeolitic catalysts (silicoaluminates) are used, preferably operating in the HC unit at pressures between 1000-2000 psig (69-138 Bar) and moderate temperature, between 338-400° C. (650-750° F.)

The process is completed with cold or hot, high-pressure and low-pressure liquid phases separation equipment of vapor and gas rich in hydrogen, hydrogen make-up and recycle compressors, strippers and fractioning of unconverted oils (UCO).

Table 2 shows the experimental results for feedstock, the yields from the different cuts obtained from the cracking process and the overall diesel production. Yields of a traditional refinery, with one FCC equipment, are compared to the yields that can be obtained using the invention, by combination of HC and FCC, under different operating conditions of the hydrocracking unit, determined by reactor conversion.

TABLE 2

| | Traditional FCC | Combination of FCC/HC with feed segregation and common fractionation | | | |
|---|---|---|---|---|---|
| HC conversion (%) | 0 | 20 | 30 | 40 | 50 |
| % Feedstock increase compared to baseline | Baseline | +10% | +17 | 23 | 26 |
| Cut yield (% w/w) | | | | | |
| Residual Gas | 6.60 | 5.79 | 5.53 | 5.30 | 5.09 |
| C3 | 5.34 | 6.39 | 6.00 | 5.65 | 5.34 |
| C4 | 9.27 | 11.61 | 11.16 | 10.76 | 10.40 |
| Gasoline | 48.30 | 54.93 | 53.66 | 52.52 | 51.49 |
| Diesel | 15.00 | 15.39 | 18.12 | 20.56 | 22.75 |
| Heavy Gas-oil | 9.00 | 0.00 | 0.00 | 0.00 | 0.00 |
| Coke | 6.49 | 5.88 | 5.52 | 5.20 | 4.92 |
| Diesel Production (% increase compared to baseline) | Baseline | +12.5% | 42% | 70% | 92% |
| Cetane number | 37 | 42 | 49 | 55 | 60 |

As shown by the experimental results in Table 2, diesel fuel production increases as the HC unit conversion increases due to the fact that not only such diesel fuel is produced in the hydrocracking process, but also by reducing the recycle of the unconverted fraction towards the FCC, it is possible to increase the feedstock flow thereof by 26% more depending on each unit, their bottlenecks or restrictions. This by itself will have a major economic impact on process yield and cost-effectiveness.

Moreover, as conversion in HC increases, gas-oil quality becomes more and more similar to the quality of diesel from hydrocracking, which is excellent. It is also possible to modify the FCC catalyst selectivity—by adjusting the hydrogen transfer capacity vs. cracking capacity—or to use octane promoters to optimize the plant overall operation towards maximum benefits, or to mitigate operating restrictions. This way, the production of petrochemical gases, the olefinicity and aromaticity of naphtha and other cuts can be increased by shifting the equilibrium FCC catalyst's characteristics.

Another aspect of great technical significance is the reduction of the sulfur and nitrogen compounds in the feedstock and the end products, thereby resulting in less hydrogen consumption in hydrodesulfurization units (HDS), whether of naphtha or diesel.

With regards to the feedstock to the FCC, an additional increased conversion will be created due to the "invisible poison" feature of nitrogen in FCC units, since it neutralizes catalyst acid sites, which are in fact the cracking catalyst active sites, but cannot be detected because nitrogen is converted in the regenerator oxidating atmosphere into NOx.

EXAMPLE 2

This example illustrates the operation of the process shown in FIG. 2, to an existing FCC unit.

Table 3 shows the properties of the feed to an existing FCC unit.

TABLE 3

| Property | Value |
|---|---|
| IBP (initial boiling point) (° C.) | 151 |
| FBP (final boiling point) (° C.) | 597 |
| Specific gravity @ 15° C. | 0.9076 |

TABLE 3-continued

| Property | Value |
|---|---|
| S (sulfur) (ppm) | 4400 |
| Basic N (basic nitrogen) (wt %) | 0.097 |

Table 4 shows the mass balance of the existing FCC unit, compared to the mass balance obtained after the implementation of the process setup described in the present invention, according to the process shown in FIG. 2.

TABLE 4

| Stream | FCC unit (Base case) | FCC unit + HC unit with feed segregation and common fractionation |
|---|---|---|
| Feed (t/d) | 4680 | 5296 |
| Residual Gas (t/d) | 307 | 304 |
| C3 + C4 (t/d) | 681 | 826 |
| Naphtha (t/d) | 2249 | 2671 |
| Gasoil (t/d) | 699 | 1230 |
| Decanted oil (t/d) | 419 | 0 |
| Coke (t/d) | 325 | 319 |

As shown, the feed rate that can be processed increases, as well as the production of products of higher commercial value, like naphtha and gasoil. Decanted oil, which is the lowest priced product, is no longer produced since it is converted to higher value products in the HC unit.

Table 5 shows some of the properties of the naphtha and gasoil produced by the common fractioning stage.

TABLE 5

| | S (ppm) | Cetane Number | RON |
|---|---|---|---|
| Naphta (IBP-221° C.) | 155 | | 93 |
| Gasoil (221° C.-360° C.) | 216 | 52 | |

The invention claimed is:

1. A method for producing diesel fuel with improved yield and quality by integration of fluidized catalytic cracking (FCC) and hydrocracking (HC), comprising the following steps:

a. segregating feedstock to one of a FCC unit and a HC unit arranged in parallel, based on the aromatic hydrocarbon content of the feedstock, wherein feedstock of a higher aromatic hydrocarbon content is fed to the HC unit;

b. processing at least a portion of the feedstock in the FCC unit, and processing at least a portion of the feedstock in the HC unit;

c. recovering a FCC effluent and a HC effluent;

d. feeding the FCC effluent and the HC effluent to a common fractionator;

e. fractionating the FCC effluent and the HC effluent in a common fractionation stage;

f. recycling an unconverted fraction from the common fractionator to the FCC unit.

2. The method according to claim 1, wherein at least a portion of the HC unit effluent is used to preheat the feed to the same unit, thus reducing its temperature before mixing with the FCC unit effluent and entering the common fractioning stage.

3. The method according to claim 1, wherein said common fractionating stage for both effluent streams from HC and FCC processes, comprises recycling an unconverted heavy gasoil to the riser of the FCC unit and further recycling a decanted gasoil to the HC unit.

4. The method according to claim 1, wherein said common fractioning stage for both effluent streams from HC and FCC processes, further comprises mixing a decanted gasoil stream with an unconverted heavy gasoil, recycling the mixture to the FCC unit, optionally recycling a portion of the decanted gasoil stream to the HC unit, thus allowing control of the carbon balance in the FCC unit.

5. The method according to claim 1, wherein the temperature of the HC unit effluent is between 300° C. and 390° C.

6. The method according to claim 1, wherein the temperature of the FCC unit effluent is between 500° C. and 580° C.

7. The method according to claim 1, wherein the hydrocracking unit is being operated with conversion rates between 20% and 60%.

8. The method according to claim 1, wherein the temperature of the HC unit effluent, after heat exchange to preheat the feed to the same unit, is between 100° C. and 250° C., and the temperature of the FCC unit effluent is about 530° C.

9. The method according to claim 1, wherein the HC unit operates with conversion between 20% and 60% and pressures between 70 Bar and 150 Bar, and temperatures between 340° C. and 400° C.

10. The method according to claim 1, wherein the HC unit operates ancillary to FCC, thereby improving a portion of the feedstock thereof, which has low performance as compared to the catalytic cracking process, and adding value thereto, by selective incorporation of hydrogen while simultaneously producing improved quality diesel.

11. The method according to claim 1, wherein the HC and FCC processes comprise silicoaluminate, catalysts, preferably of the zeolitic type, preferably operating in the HC unit at a pressure between 1000-2000 psig (69-138 bar) and moderate temperature, between 338-400° C., and in the FCC unit at pressure between 2-5 bar and temperature between 500-580° C.

12. The method according to claim 1, wherein the HC effluent exchanges heat by direct countercurrent contact with the hot vapors coming from FCC unit in the contactor of flash section zone of the main fractionator, and minimal pump-around circulation is adjusted for stable balanced operation and for shutdown events.

13. The method according to claim 1, wherein contaminants which are present in hydrocracking products are stripped in the contactor of flash section zone of the main fractionator by hot gases of FCC, and light and medium hydrocarbons are distilled together with FCC products.

* * * * *